US005528861A

United States Patent [19]

Beyerlein

[11] Patent Number: 5,528,861

[45] Date of Patent: Jun. 25, 1996

[54] CABLE-ACTUATED VEHICLE WINDOW LIFTER

[75] Inventor: Gastone Beyerlein, Pulheim, Germany

[73] Assignee: Ford Motor Company, Dearborn, Mich.

[21] Appl. No.: 489,010

[22] Filed: Jun. 8, 1995

[30] Foreign Application Priority Data

Jun. 8, 1994 [DE] Germany ..... 44 20 008.0

[51] Int. Cl.[6] ..... E05F 11/48

[52] U.S. Cl. ..... 49/352; 49/349; 49/374

[58] Field of Search ..... 49/348, 352, 322, 49/374, 349, 375

[56] References Cited

U.S. PATENT DOCUMENTS

| | | | |
|---|---|---|---|
| 4,637,166 | 1/1987 | Ujihara | 49/352 |
| 4,700,508 | 10/1987 | Köllner et al. | 49/352 |
| 4,819,377 | 4/1989 | Bauer et al. | 49/349 X |
| 4,829,711 | 5/1989 | Sambor | 49/352 X |
| 5,018,305 | 5/1991 | Kuki et al. | 49/352 X |
| 5,461,826 | 10/1995 | Heckel et al. | 49/352 X |

FOREIGN PATENT DOCUMENTS 3144496 9/1986 Germany .

3815036 11/1989 Germany .

*Primary Examiner*—Kien T. Nguyen

*Attorney, Agent, or Firm*—David B. Kelley; Roger L. May

[57] ABSTRACT

In a cable-actuated window lifter, especially for motor vehicles with a driver (3) carrying a window panel (1) along a guide track (2), motor-driven or hand-operated adjustment mechanism (4, 4*a* and 4*b*) engaging directly into the retainer (3), and a braking device (5), which prevents an independent movement of the window panel (1) with the adjustment mechanism in rest position, whereby the braking device (5) is placed on the retainer (3) and includes at least one brake which can be pivoted around a bearing block (6), which, when the adjustment device (4) is in rest position, lays against at least one lateral surface (a) of the guide track (2) in a braking, preferably self-restraining, manner thereby releasing the guide track (2) when the adjustment device (4) is engaged, the brake being designed as a clamping block (7)placed off-center on the bearing pin (6), with two curved arcs (d and e) spiraling in opposite direction from its center (c), and being pre-loaded in clamping direction (Y) by a spring (8), thereby establishing the control track (2) as a C-profile, on whose adjoining lateral surfaces (a, b) are clamped the curved arcs (d and e) of the clamping block (7), onto which are clamped the ends of the cable-actuated adjustment device (4*a* and 4*b*) on different sides in release direction (X) relative to its bearing pin (6).

2 Claims, 4 Drawing Sheets

FIG.1
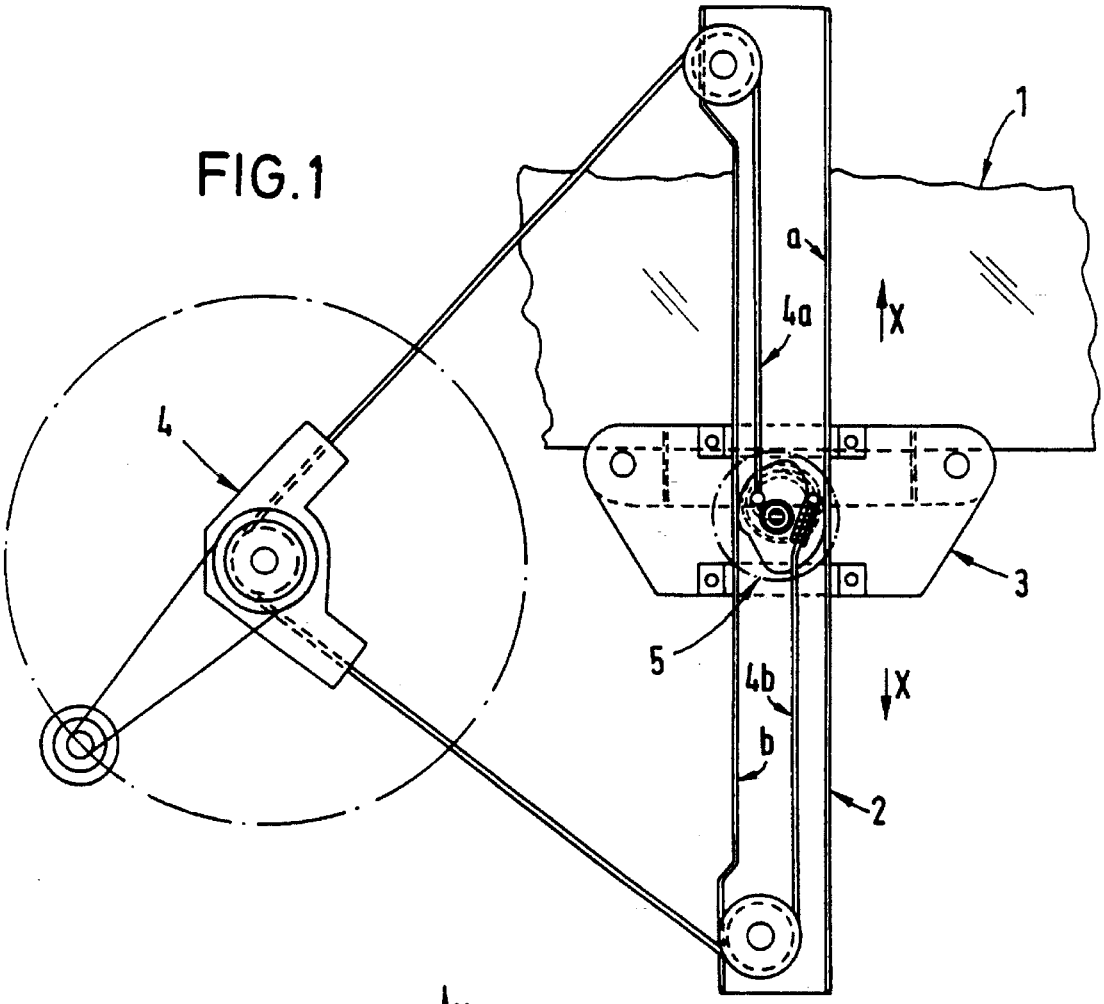
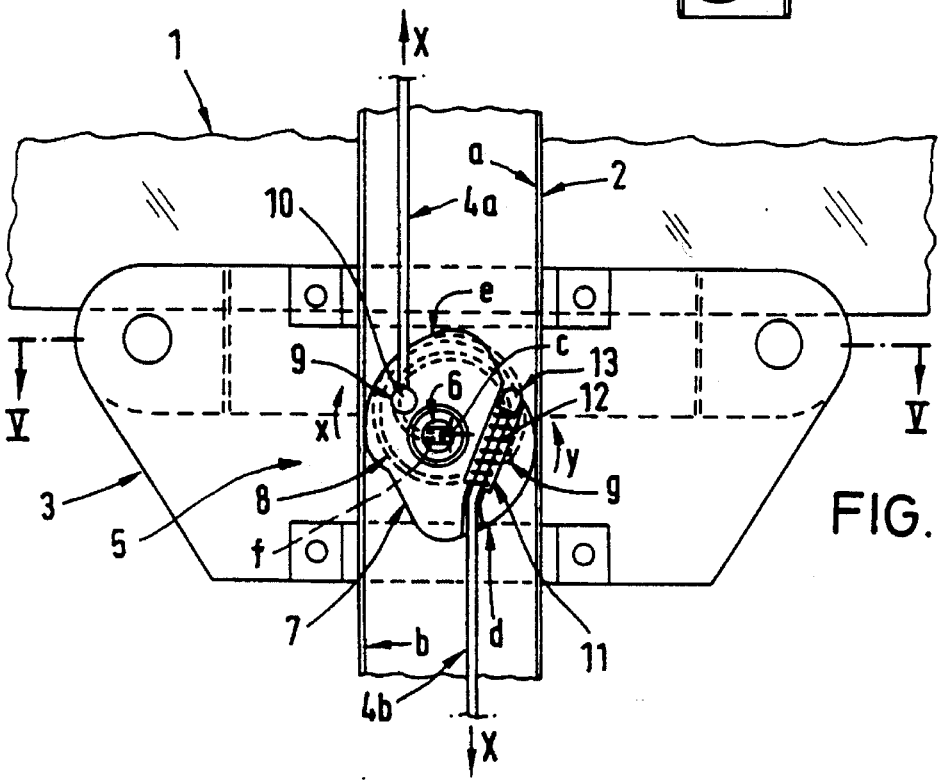
FIG.2

FIG.6
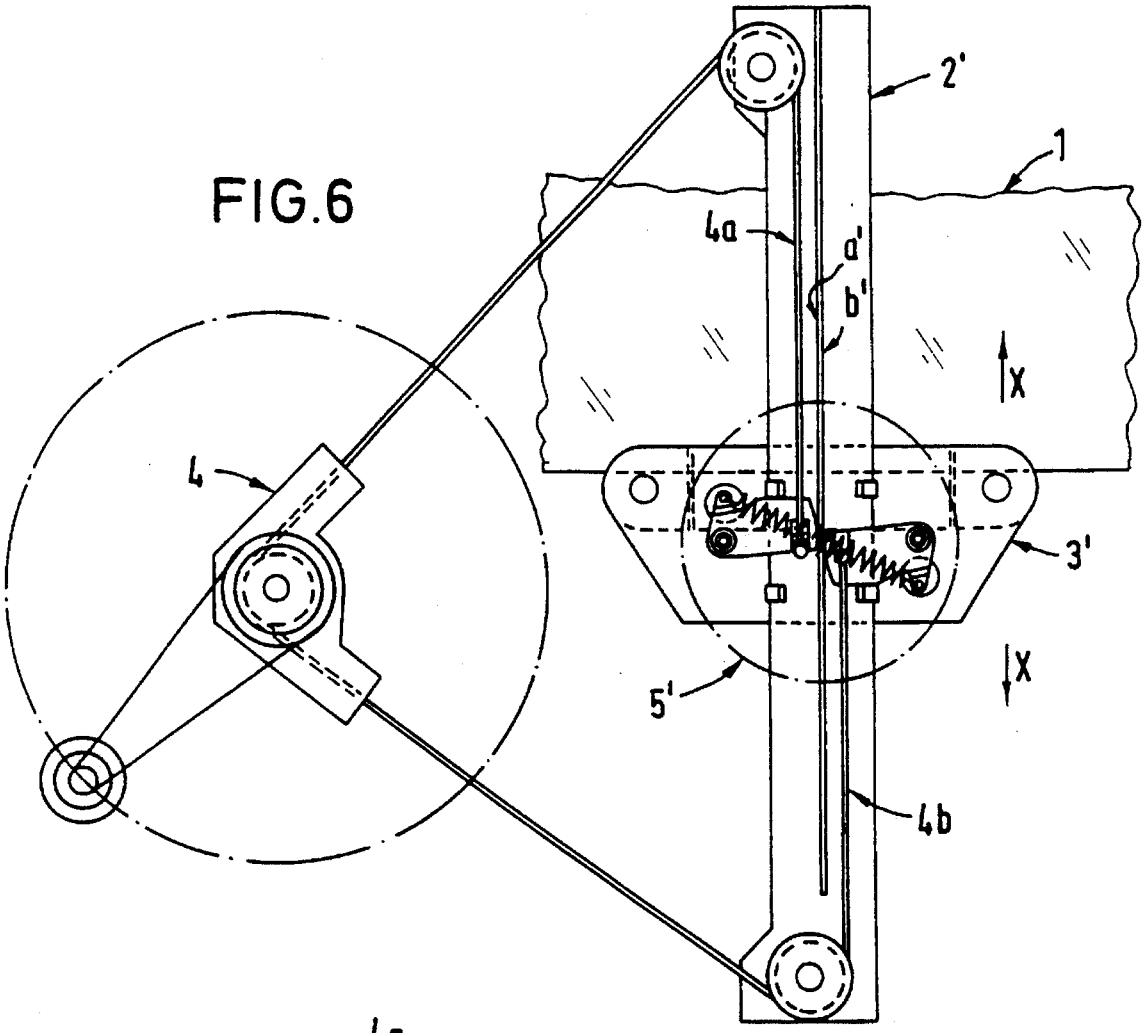
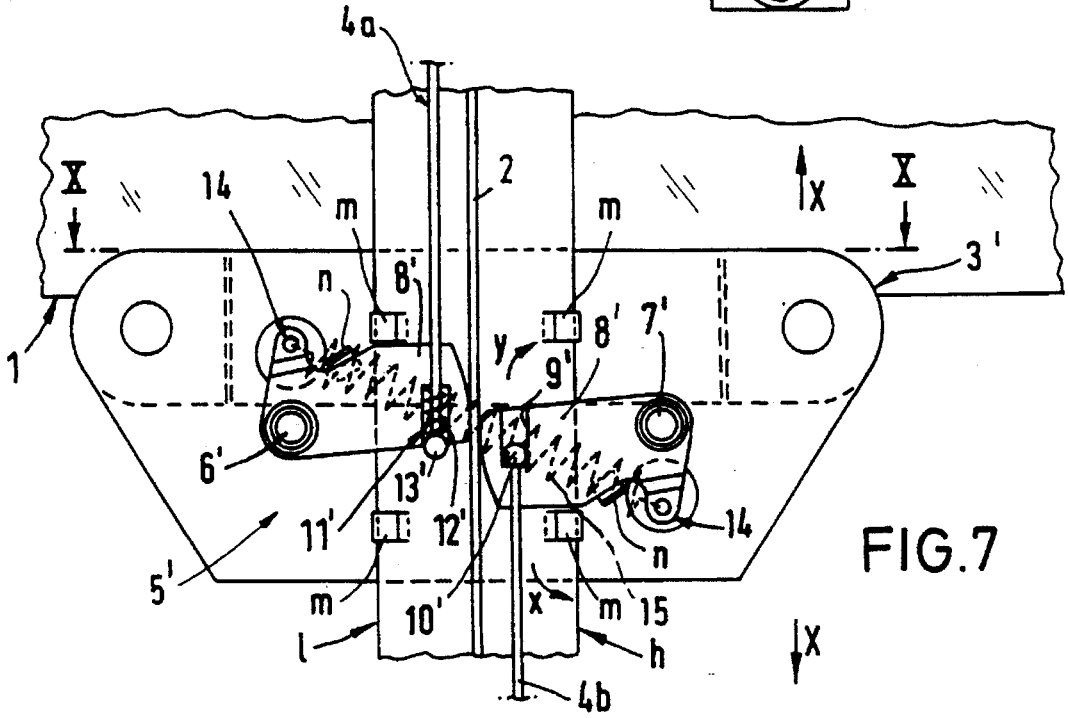
FIG.7

CABLE-ACTUATED VEHICLE WINDOW LIFTER

FIELD OF THE INVENTION

The invention concerns a cable-actuated window lifter, especially for motor vehicles, and, more particularly, a window lifter having a spring loaded brake acting upon a guide track.

BACKGROUND OF THE INVENTION

A cable-actuated window lifter is known from German patent application DE-OS 38 15 036 in which a braking device attached to a retainer consists of two counteracting braking elements acting upon the guide rails. This known cable-actuated window lifter, in turn, requires a relatively expensive resetting element and, as a whole, is very expensive to manufacture.

SUMMARY OF THE INVENTION

The present invention provides an inexpensively manufacturable cable-actuated window lifter for a vehicle window having a window panel movable along a guide track. The window lifter comprises a retainer for carrying the window panel along the guide track, an adjustment mechanism having a cable with a pair of cable ends operatively engaged with the retainer for moving the window panel along the guide track when in an adjustment mode and for holding the window panel in a stationary position when in a rest mode, and brake means mounted to the retainer for preventing inadvertent movement of the window pane when the adjustment mechanism is in the rest mode. The brake means preferably comprises, in a first embodiment, at least one clamping block hinged around a bearing pin connected to the retainer, and having at least one side with a curved arc, the cable ends attached to the at least one clamping block from opposing longitudinal directions of the guide track, the brake means also having a coil spring one end of which is attached to the bearing pin and the other end attached to one of the curved arcs so as to bias the clamping block in a braking position. When the adjustment mechanism is in the rest mode, the at least one clamping block frictionally abuts against at least one lateral face of the guide track in a braking manner. When the adjustment mechanism is in the adjustment mode the cable ends are pulled longitudinally along the guide track by the adjustment mechanism thus overcoming the bias force of the spring and rotating the at least one clamping block around the bearing pins to a position released from contact with the opposing lateral faces of the guide to allow the retainer to move along the guide track.

In a second embodiment, the brake means comprises a pair of brake cams, one hinged to a bearing pin and the other hinged to a bearing pin, both of said bearing pins connected to the retainer, with one of the cable ends attached to one of the brake cams and the other of the cable ends attached to the other of the brake cams from opposing longitudinal directions of the guide track. A tension spring has ends attached to arms on the brake cams so as to bias the brake cams to a braking position against opposite lateral faces of a poriton of the guide track.

The advantage of the present invention is a cable-actuated window lifter, especially for motor vehicles, which has structural simplicity while providing the requisite functionality.

BRIEF DESCRIPTION OF THE DRAWINGS

The objects, advantages, and features of the present invention will be apparent to those skilled in the art with reference to the drawings, of which:

FIG. 1 is a lateral view, limited to the essential of a cable-actuated window lifter according to the invention;

FIG. 2 is a partial view of the cable-actuated window lifter per FIG. 1, in its "stationary" or "blocked" position;

FIG. 6 is a lateral view, limited to the essential elements, of a second embodiment of the cable-actuated window lifter according to the invention;

FIG. 7 is a partial view of the cable-actuated window lifter per FIG. 6, in its "stationary" or "blocked" position;

DESCRIPTION OF THE PREFERRED EMBODIMENTS

Figure 3:
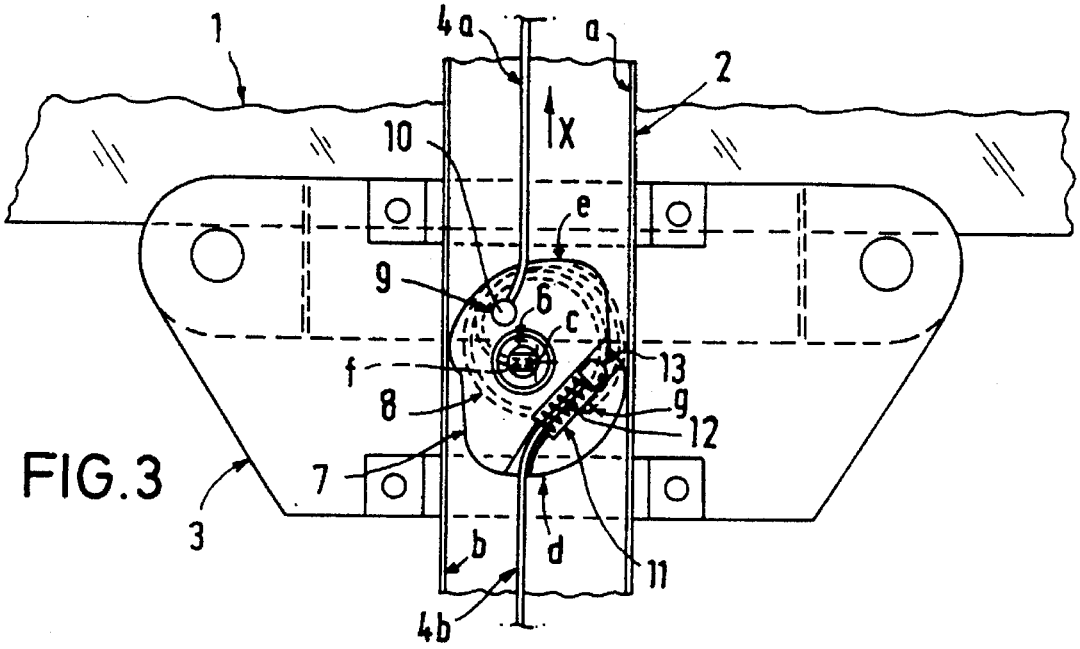
FIG. 3 is a partial view of the cable-actuated window lifter in its "free" position by pull action from above.

In the cable-actuated window lifter shown in FIG. 1, a retractable window panel I can be raised or lowered along a guide rail 2 located in the vehicle door frame, by means of a movable retainer 3. A motor or hand-operated adjusting mechanism 4 clamps directly on the retainer 3 via corresponding control cable ends 4*a* and 4*b*. The adjusting mechanism 4 clamps on a braking device 5 whose basics only are shown in FIG. 1 and whose characteristics will be explained in greater detail in connection with FIG. 2, in which its characteristics are provided with the corresponding reference numbers.

As depicted in greater detail in FIG. 2, the brake device 5 prevents an automatic movement of the window panel I when the adjusting mechanism is not engaged. The braking device 5 is placed on the retainer 3 and consists of a clamping block 7 hinged around a bearing pin 6 which, when the adjustment mechanism 4 is not engaged, rests at least one side surface on the guide rail 2 in a braking manner, preferably self-restraining, and when the adjustment mechanism 4 is activated, releases the guide rails 2.

The clamping block 7, placed eccentrically on the bearing pin 6, is composed of two curved arcs d and e spiraling from a central point c toward opposite sides, and being pre-loaded in clamping direction y by a spring 8. The guide rail 2 is preferably constructed with a C-section shaped profile, on whose adjoining lateral walls a and b are clamped the curved arcs d and e of the clamping block 7. The ends of the adjustment mechanism 4*a* and 4*b* clamp onto the clamping block 7 with reference to its bearing pin 6, on various sides of release direction x. The corresponding movement direction of the ends of the control-cable adjustment mechanism 4*a* and 4*b* is indicated with an arrow and with an X.

The spring 8 pre-loading the clamping block 7 in clamping direction y is preferably designed as a coil spring, one end f of which is placed on the bearing pin 6 and whose other end g is attached to one of the curving arcs.

Figure 4:
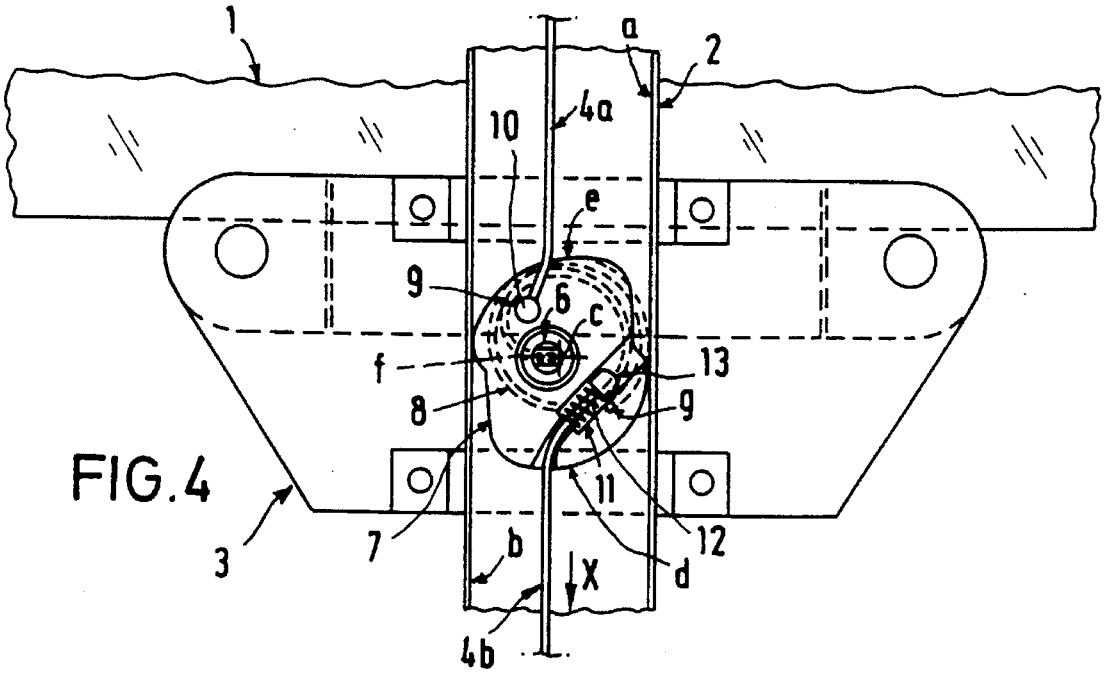
FIG. 4 is a partial view of the cable-actuated window lifter in its "free" position by pull action from below.
Figure 5:
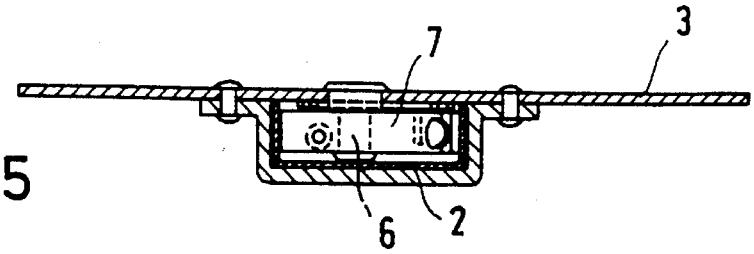
FIG. 5 is a section along line V—V of FIG. 2.

The ends of the cable-actuated adjustment mechanism 4*a* and 4*b* grasping the clamping block 7 in release direction X are designed in the shape of a simple cable nipple 10 reaching into a groove 9, and on the other end, in the form of a pre-loaded cable nipple 13 by means of a coil spring 12 located in a pocket hole 11. FIGS. 3 and 4 show the corresponding release positions of the clamping block, whereby the actually active cable-controlled adjustment mechanism end 4*a* and 4*b*, respectively, is indicated by the arrow X.

In an alternative embodiment of the invention shown in FIG. 6, matching parts of the cable-actuated window lifter according to the invention are indicated with the same reference symbols, while other non-matching components are identified with a prime (') index. A window panel 1 is movable along a guide rail 2' by means of a retainer 3', on which, in turn, a motor or hand-operated adjustment mechanism 4 with cable ends 4*a* and 4*b* engages into a braking device 5'. In this embodiment, the guide rail 2' is a T-shaped guide rail with a top section and a bottom portion, the latter having lateral surfaces a' and b' provided thereon for interaction with the braking device 5'. The braking device 5' has a pair of clamping cams 8', hinged around bearing pins 6' and 7, respectively, which are biased in clamping direction y by means of a spring 15 attached to arms 14 of the clamping cams. Hereby, the clamping cams 8' act against the lateral surfaces a' and b', and the ends of cable-actuated adjustment device 4*a* and 4*b* are attached to the clamping cams 8' in release direction X. Advantageously, the clamping blocks 8' can be identical in shape, thus reducing manufacturing costs when making them from powdered metals or as an injection-molded part, since only one mold is required.

The tilting motion of the clamping cams 8' in a release direction permits the retainer 3' and the window panel 1 to be carried along in the direction of the motion.

Lateral edges h and l on the guide track 2' are overlapped by control slots m protruding from the retainer 3' in order to provide control therefor and to facilitate a smoothly running guide action of the retainer therealong. A pair of stops n on the retainer 3' adjoining the brake cams 8' carry the retainer 3' and the window panel 1 in the desired direction, for example release direction X, after the brake cams 8' have been released and the adjustment mechanism 4 is in the adjustment mode.

The control-cable adjustment ends 4*a* and 4*b* engaging the clamping cam 8' in release direction X are, respectively, shaped like a cable nipple 10' for engaging a cutout 9', and a cable nipple 13' biased via a coil spring 12' is placed in a pocket hole 11'.

Figure 8:
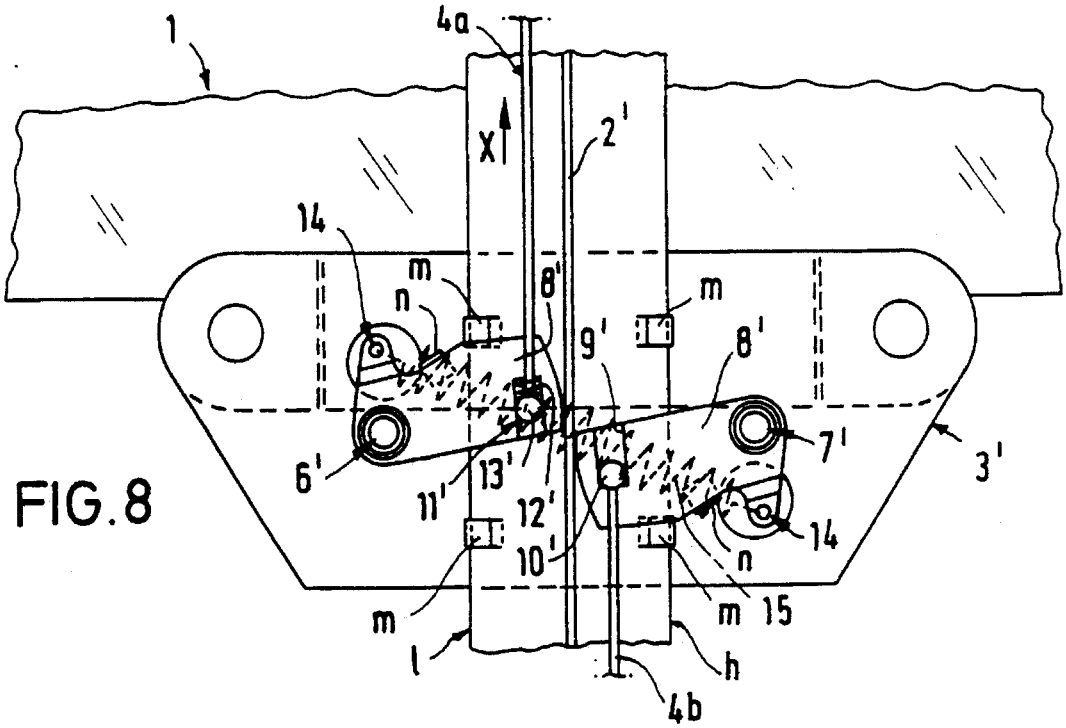
FIG. 8 is a partial view of the cable-actuated window lifter in its "free" position by pull action from above.
Figure 9:
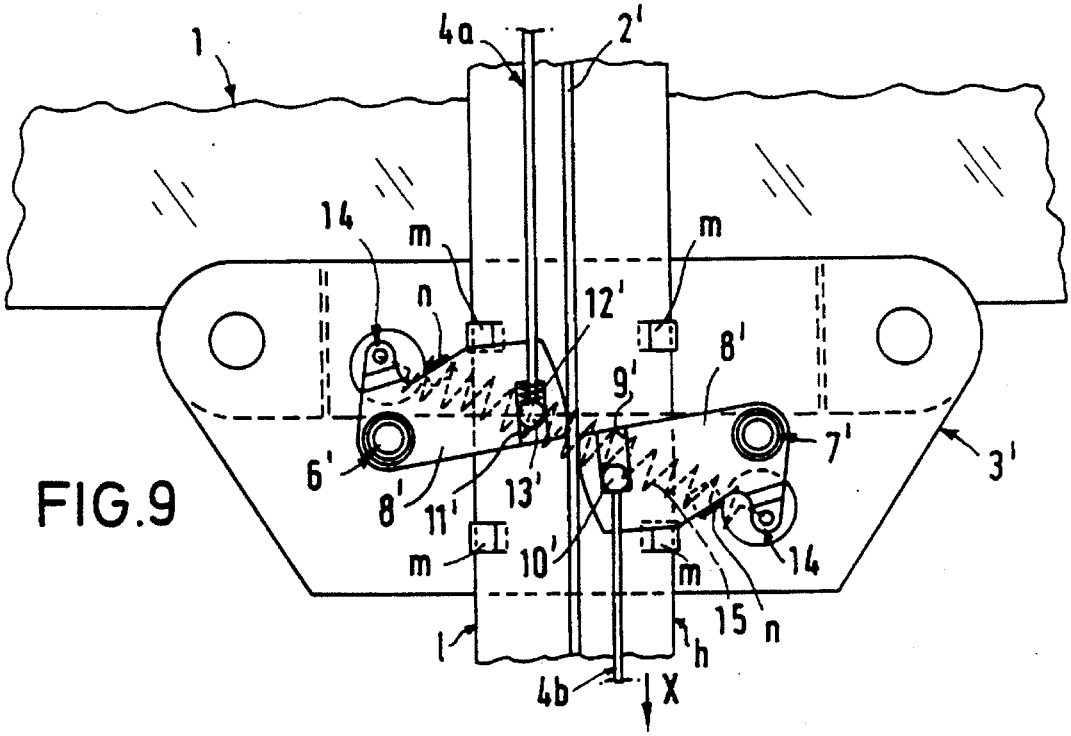
FIG. 9 is a partial view of the cable-actuated window lifter in its "free" position by pulling action from below.
Figure 10:
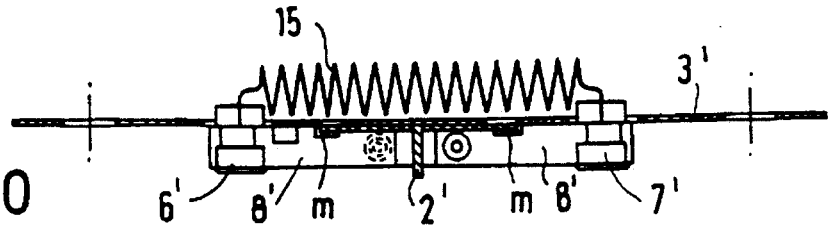
FIG. 10 is a section along line X—X in FIG. 7.

FIGS. 8 and 9 show the window winder of the second embodiment of the invention in each of its release positions, once when subjected to tension from above, and once when under tension from below, respectively.

Those skilled in the art will recognize that embodiments other than those described are possible, limited only by the following claims.

I claim:

1. A cable-actuated window lifter for a vehicle window having a window panel (1) movable along a C-shaped guide track (2), the window lifter comprising:

a retainer (3) for carrying the window panel (1) along the guide track (2);

an adjustment mechanism (4) having a cable with a pair of cable ends operatively engaged with the retainer for moving the window panel along the guide track when in an adjustment mode and for holding the window panel in a stationary position when in a rest mode; and brake means (5) mounted to the retainer for preventing inadvertent movement of the window pane (1) when the adjustment mechanism (4) is in the rest mode, the brake means comprising:

at least one clamping block (7) hinged around a bearing pin (6) connected to the retainer and having at least one side with a curved arc, the cable ends attached to the at least one clamping block from opposing longitudinal directions of the guide track; and a coil spring (8) one end of which is attached to the bearing pin (6) and the other end attached to one of the curved arcs so as to bias the clamping block in a braking position such that:

the at least one clamping block frictionally abuts against at least one lateral face of the guide track in a braking manner when the adjustment mechanism is in the rest mode; and when the adjustment mechanism is in the adjustment mode the cable ends are pulled longitudinally along the guide track by the adjustment mechanism thus overcoming the bias force of the spring and rotating the at least one clamping block around the bearing pins to a position released from contact with the opposing lateral faces of the guide to allow the retainer to move along the guide track.

2. A window lifter according to claim 1 wherein one of the cable ends has a first cable nipple (10) for attaching to a recess in the at least one clamping block, and the other end has a second cable nipple spring-biased within a pocket hole (11) in the at least one clamping block.

* * * * *